US009085449B2

(12) United States Patent
Goldman et al.

(10) Patent No.: US 9,085,449 B2
(45) Date of Patent: Jul. 21, 2015

(54) ASEPTIC DOSING SYSTEM

(75) Inventors: James E. Goldman, Dunwoody, GA (US); Hubertus Ulrich Schubert, Smyrna, GA (US); Peter Simpson, Atlanta, GA (US); Marcelo Silvado, Roswell, GA (US)

(73) Assignee: The Coca-Cola Company, Atlanta, GA (US)

( * ) Notice: Subject to any disclaimer, the term of this patent is extended or adjusted under 35 U.S.C. 154(b) by 1266 days.

(21) Appl. No.: 12/719,028

(22) Filed: Mar. 8, 2010

(65) Prior Publication Data

US 2011/0214779 A1 Sep. 8, 2011

(51) Int. Cl.

| | |
|---|---|
| ***B67C 3/20*** | (2006.01) |
| ***B65B 3/04*** | (2006.01) |
| ***B65B 55/12*** | (2006.01) |

(52) U.S. Cl.

CPC . *B67C 3/208* (2013.01); *B65B 3/04* (2013.01); *B65B 55/12* (2013.01); *B65B 2220/14* (2013.01)

(58) Field of Classification Search

USPC ..... 141/12, 69, 85, 90–92; 210/748.01; 222/189.11, 189.06, 129.1, 145.1

See application file for complete search history.

(56) References Cited

U.S. PATENT DOCUMENTS

| | | | | |
|---|---|---|---|---|
| 4,072,610 | A * | 2/1978 | Gow et al. | 210/90 |
| 4,160,727 | A * | 7/1979 | Harris, Jr. | 210/639 |
| 4,528,093 | A * | 7/1985 | Winer | 210/96.2 |
| 4,861,559 | A | 8/1989 | Sugisawa et al. | |
| 5,911,884 | A * | 6/1999 | Boulter | 210/739 |
| 5,992,685 | A * | 11/1999 | Credle, Jr. | 222/1 |
| 6,093,312 | A * | 7/2000 | Boulter | 210/86 |
| 6,119,433 | A | 9/2000 | Kitahora et al. | |
| 6,405,764 | B1 * | 6/2002 | Wang | 141/12 |
| 6,405,900 | B1 * | 6/2002 | Kown | 222/190 |
| 6,685,059 | B2 * | 2/2004 | Jones et al. | 222/129.1 |
| 7,316,249 | B2 * | 1/2008 | Cheong | 141/100 |
| 7,377,407 | B2 * | 5/2008 | Boulter et al. | 222/320 |
| 7,595,470 | B1 * | 9/2009 | Sizer et al. | 219/689 |
| 2007/0267441 | A1 | 11/2007 | Van Opstal et al. | |
| 2008/0023099 | A1 | 1/2008 | Schybert et al. | |
| 2008/0271809 | A1 | 11/2008 | Goldman et al. | |
| 2010/0030355 | A1 | 2/2010 | Insolia et al. | |

FOREIGN PATENT DOCUMENTS

| | | | |
|---|---|---|---|
| CN | 1013319968 | A | 12/2008 |
| EP | 0229995 | A1 | 7/1987 |
| FR | 1 128 920 | A | 1/1957 |
| FR | 2 526 274 | A1 | 11/1983 |
| WO | 96/18541 | A1 | 6/1996 |
| WO | 2008/014333 | A2 | 1/2008 |
| WO | 2009/012013 | A1 | 1/2009 |
| WO | 2009/046386 | A1 | 4/2009 |
| WO | 2010/017888 | A1 | 2/2010 |

* cited by examiner

*Primary Examiner* — Timothy L Maust

(74) *Attorney, Agent, or Firm* — Sutherland Asbill & Brennan LLP

(57) ABSTRACT

The present application provides an aseptic dosing system for dispensing a micro-ingredient. The aseptic dosing system may include a micro-ingredient source adapted to dispense the micro-ingredient, a sterilizer downstream of the micro-ingredient source configured to sterilize the micro-ingredient, and a nozzle downstream of the sterilizer configured to reconstitute the micro-ingredient in or downstream thereof.

19 Claims, 5 Drawing Sheets

ASEPTIC DOSING SYSTEM

TECHNICAL FIELD

The present application relates generally to high-speed container filling systems and more particularly relates to filling systems that combine streams of ingredients, such as concentrate, water, sweetener, and/or other ingredients in an aseptic fashion.

BACKGROUND OF THE INVENTION

Beverage bottles and cans are generally filled with a beverage via a batch process. The beverage components (usually concentrate, sweetener, and water) are mixed in a blending area and then carbonated if desired. The finished beverage product is then pumped to a filler bowl. The containers are filled with the finished beverage product via a filler valve as the containers advance along a filling line. The containers then may be capped, labeled, packaged, and transported to the consumer. Depending upon the nature of the beverage and local custom, certain beverages may be cold filled, filled in a hot fill process, or filled using an aseptic process and the like to ensure purity therein.

As the number of different beverage products continues to grow, however, bottlers may face increasing amounts of downtime because the filling lines need to be changed over from one product to the next. This can be a time consuming process in that the tanks, pipes, filler bowls, and other equipment must be flushed with water and sanitized before being refilled with the next product batch. Bottlers thus may be reluctant to produce a small volume of a given product because of the required downtime between production runs. Moreover, the sanitation process may involve the use of a significant amount of water and/or sanitizing chemicals.

Not only is there a significant amount of downtime in changing products, the downtime also results when adding various types of ingredients to the product. For example, it may be desirable to add an amount of calcium to an orange juice beverage. Once the run of the orange juice with the calcium is complete, however, the same flushing and sanitation procedures must be carried out to remove any trace of the calcium or other type of additive. As a result, customized runs of beverages with unique additives simply are not favored given the required downtime.

Thus, there is a desire for an improved high speed filling system that can quickly adapt to filling different types of products as well as products with varying additives. The system preferably can produce these products without downtime or costly changeover and sanitation procedures. The system also should be able to produce both high volume and customized products in a high speed and efficient manner. There is also a desire to produce a mix of flavors or beverages simultaneously.

SUMMARY OF THE INVENTION

The present application thus provides an aseptic dosing system for dispensing a micro-ingredient. The aseptic dosing system may include a micro-ingredient source adapted to dispense the micro-ingredient, a sterilizer downstream of the micro-ingredient source configured to sterilize the micro-ingredient, and a nozzle downstream of the sterilizer configured to reconstitute the micro-ingredient in or downstream thereof.

The aseptic dosing system further may include a number of micro-ingredient sources in communication with the nozzle, one or more macro-ingredient sources in communication with the nozzle, and a pump downstream or upstream of the sterilizer. The aseptic dosing system further may include a sterile zone with the nozzle positioned therein.

The sterilizer may include a mesh. The mesh may have openings of less than about 0.45 microns or so. The sterilizer may include a pasteurizer, a microwave pasteurizer, an electron beam sterilization system, an ultraviolet light system, and a high pressure system.

The present application further may provide an aseptic filling method. The method may include the steps of providing one or more micro-ingredients therein, passing one of the micro-ingredients through a sterilizer, flowing the sterilized micro-ingredient to a nozzle, and reconstituting the sterilized micro-ingredient in or downstream of the nozzle.

The step of passing one of the micro-ingredients through a sterilizer may include passing one of the micro-ingredients through a mesh, passing one of the micro-ingredients through a pasteurizer, passing one of the micro-ingredients through an electron beam sterilization system, passing one of the micro-ingredients through an ultraviolet light system, and passing one of the micro-ingredients through a high pressure system.

The present application further provides an aseptic dosing system. The aseptic dosing system may include an aseptic micro-ingredient source with a micro-ingredient therein, a sterile zone downstream of the aseptic micro-ingredient source, an aseptic fitting positioned about the sterile zone and in communication with the aseptic micro-ingredient source, and a nozzle positioned within the sterile zone such that the micro-ingredient is pumped from the aseptic micro-ingredient source and reconstituted in or downstream of the nozzle.

These and other features and improvements of the present application will become apparent to one of ordinary skill in the art upon review of the following detailed description when taken in conjunction with the several drawings and the appended claims.

DETAILED DESCRIPTION

Figure 1:
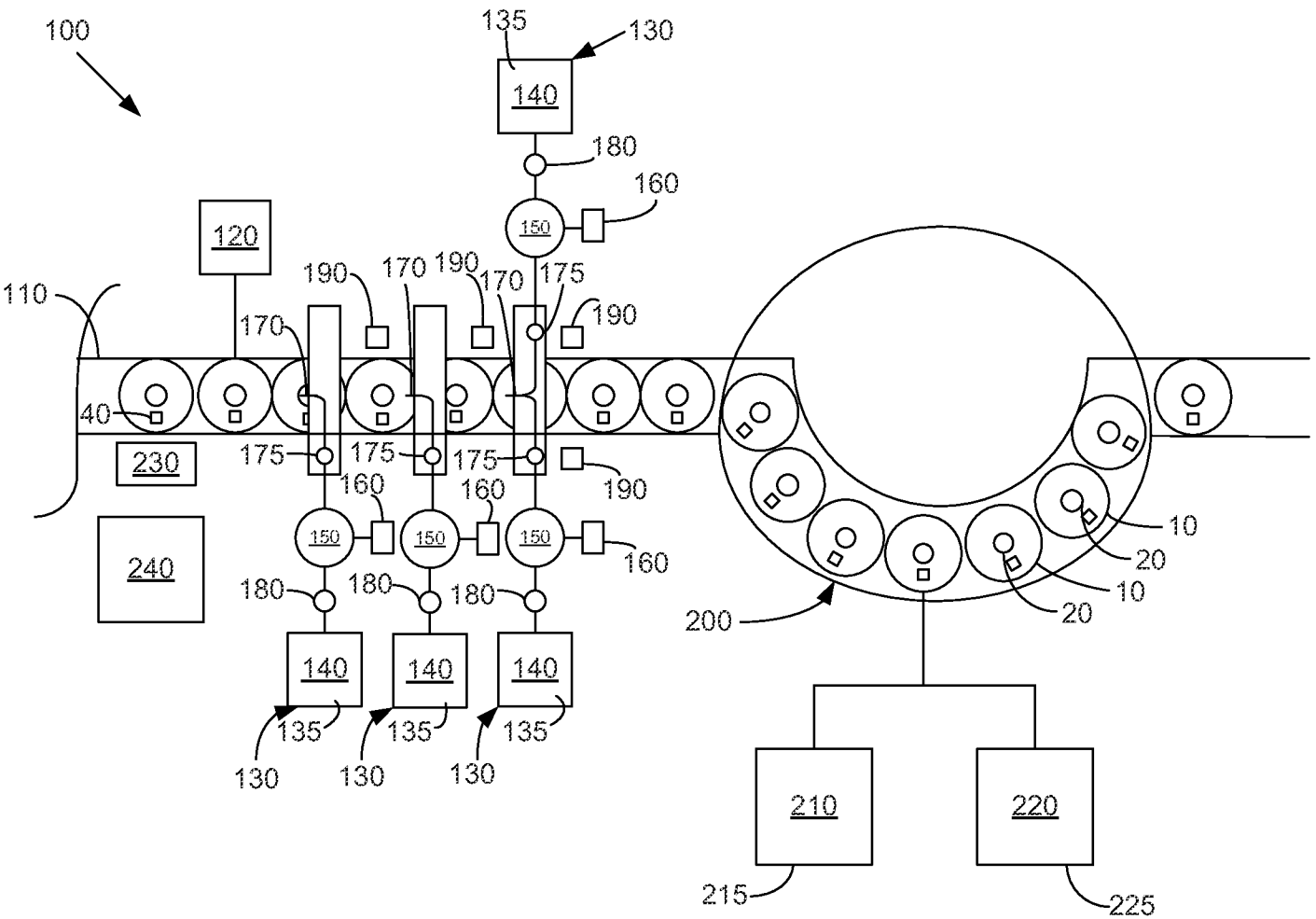
FIG. 1 is a schematic view of a high speed filling line as is described herein.

Generally described, many beverage products include two basic ingredients: water and "syrup". The "syrup" in turn also can be broken down to sweetener and flavoring concentrate.

In a carbonated soft drink, for example, water is over eighty percent (80%) of the product; sweetener (natural or artificial) is about fifteen percent (15%); and the remainder may be flavoring concentrate. The flavoring and/or coloring concentrate may have reconstitution ratios of about 150 to 1 or more. At such a concentration, there may be about 2.5 grams of concentrated flavoring in a typical twelve (12) ounce beverage or so.

The beverage thus can be broken down into macro-ingredients, micro-ingredients, and water. The macro-ingredients may have reconstitution ratios, i.e., dilution ratios, in the range of more than about one to one to less than about ten to one and/or make up at least about ninety percent (90%) of a given beverage volume when combined with the diluent regardless of the reconstitution ratios. The macro-ingredients typically have a viscosity of about 100 centipoise or higher. The macro-ingredients may include sugar syrup, HFCS (High Fructose Corn Syrup), juice concentrates, and similar types of fluids. Similarly, a macro-ingredient base product may include sweetener, acid, and other common components. The macro-ingredients may or may not need to be refrigerated. The macro-ingredients may need to be pasteurized.

The micro-ingredients may have reconstitution ratios ranging from at least about ten to one or higher and/or make up no more than about ten percent (10%) of a given beverage volume regardless of the reconstitution ratios. Specifically, many micro-ingredients may be in the reconstitution range of about 50 to 1 to about 300 to 1 or higher. The viscosity of the micro-ingredients typically ranges from about 1 to about 215 centipoise or so. Examples of micro-ingredients include natural and artificial flavors; flavor additives; natural and artificial colors; artificial sweeteners (high potency or otherwise); additives for controlling tartness, e.g., citric acid, potassium citrate; functional additives such as vitamins, minerals, herbal extracts; nutricuticals; and over the counter (or otherwise) medicines such as acetaminophen and similar types of materials. Likewise, the acid and non-acid components of the non-sweetened concentrate also may be separated and stored individually. The micro-ingredients may be in liquid, powder (solid), or gaseous forms, and/or combinations thereof. The micro-ingredients may or may not require refrigeration. Substances typically used for applications other than beverages, such as paints, dyes, pigments, oils, cosmetics, pharmaceuticals, fragrances, etc. also may be used as micro-ingredients. Various types of alcohols, oils, or other organic solvents also may be used as micro or macro-ingredients, particularly for non-food applications.

Various methods for combining these micro-ingredients and macro-ingredients are disclosed in commonly owned U.S. patent application Ser. No. 11/276,550, entitled "Beverage Dispensing System"; U.S. patent application Ser. No. 11/276,549, entitled "Juice Dispensing System"; and U.S. patent application Ser. No. 11/276,553, entitled "Methods and Apparatuses For Making Compositions Comprising An Acid and An Acid Degradable Component and/or Compositions Comprising A Plurality of Selectable Components". Likewise, an example of a high-speed filling system is shown in commonly owned U.S. patent application Ser. No. 11/686,387, entitled "Multiple Stream Filling System". These patent applications are incorporated herein by reference in full.

The filling devices and methods described hereinafter are intended to fill a number of containers 10 in a high-speed fashion. The containers 10 are shown in the context of conventional beverage bottles. The containers 10, however, also may be in the form of cans, cartons, pouches, cups, buckets, drums, or any other type of liquid containing devices. The nature of the devices and methods described herein is not limited by the nature of the containers 10. Any sized or shaped container 10 may be used herein. Likewise, the containers 10 may be made out of any type of conventional material. The containers 10 may be used with beverages and other types of consumable products as well as any nature of nonconsumable products. Each container 10 may have one or more openings 20 of any desired size and a base 30.

Each container may have an identifier 40 such as a barcode, a Snowflake code, color code, RFID tag, or other type of identifying mark positioned thereon. The identifier 40 may be placed on the container 10 before, during, or after filling. If used before filling, the identifier 40 may be used to inform the filling line 100 as to the nature of the ingredients to be filled therein as will be described in more detail below. Any type of identifier or other mark may be used herein.

Referring now to the drawings, in which like numerals refer to like elements throughout the several views, FIG. 1 shows a filling line 100 as is described herein. The filling line 100 may include a conveyor 110 for transporting the containers 10. The conveyor 110 may be a conventional single lane or multi-lane conveyor. The conveyor 110 may be capable of both continuous and intermittent motion. The speed of the conveyor 110 may be varied. The conveyor 110 may operate at about 0.42 to about 4.2 feet per second (about 0.125 to about 1.25 meters per second). A conveyor motor 120 may drive the conveyor 110. The conveyor motor 120 may be a standard AC device. Other types of motors include Variable Frequency Drive, servomotors, or similar types of devices. Examples of suitable conveyors 110 include devices manufactured by Sidel of Octeville sur Mer, France under the mark Gebo, by Hartness International of Greenville, S.C. under the mark GripVeyor, and the like. Alternatively, the conveyor 110 may take the form of a star wheel or a series of star wheels or other type of rotating pathway. The conveyor 110 may split into any number of individual lanes. The lanes may then recombine or otherwise extend.

The filling line 100 may have a number of filling stations positioned along the conveyor 110. Specifically, a number of micro-ingredient dosers 130 may be used. Each micro-ingredient doser 130 supplies one or more doses of a micro-ingredient 135 as is described above to a container 10. More than one dose may be added to the container 10 depending upon, the speed of the container 10 and size of the opening 20 of the container 10.

Each micro-ingredient doser 130 includes one or more micro-ingredient supplies 140. Each micro-ingredient supply 140 may be any type of container with a specific micro-ingredient 135 therein. The micro-ingredient supply 140 may or may not be temperature controlled. The micro-ingredient supply 140 may be refillable or replaceable.

Each micro-ingredient doser 130 also may include a pump 150 in fluid communication with the micro-ingredient supply 140. In this example, the pump 150 may be a positive displacement pump or a similar type of pumping device. Specifically, the pump 150 may be a valved or valveless pump. Examples include a valveless pump such as the CeramPump sold by Fluid Metering, Inc. of Syosset, N.Y. or a sanitary split case pump sold by IVEK of North Springfield, Vt. The valveless pump operates via the synchronous rotation and reciprocation of a piston within a chamber such that a specific volume is pumped for every rotation. The flow rate may be adjusted as desired by changing the position of the pump head. Other types of pumping devices such as a piezo electric pump, a pressure/time device, a rotary lobe pump, and similar types of devices may be used herein.

A motor 160 may drive the pump 150. In this example, the motor 160 may be a servomotor or a similar type of drive device. The servomotor 160 may be programmable. An example of a servomotor 160 includes the Allen Bradley line of servomotors sold by Rockwell Automation of Milwaukee, Wis. The servomotor 160 may be variable speed and capable of speeds up to about 5000 rpm. Other types of motors 160 such as stepper motors, Variable Frequency Drive motors, an AC motor, and similar types of devices may be used herein.

Each micro-ingredient doser 130 also may include a nozzle 170. The nozzle 170 is positioned downstream of the pump 150. The nozzle 170 may be positioned about the conveyor 110 so as to dispense a dose of a micro-ingredient 135 into the container 10. The nozzle 170 may be in the form of one or more elongated tubes of various cross-sections with an outlet adjacent to the containers 10 on the conveyor 110. Other types of nozzles 170 such as an orifice plate, an open ended tube, a valved tip, and similar types of devices may be used herein. A check valve 175 may be positioned between the pump 150 and the nozzle 170. The check valve 175 prevents any excess micro-ingredient 135 from passing through the nozzle 170 and/or may prevent backflow to the micro-ingredient supply 140. The micro-ingredients 135 may be dosed sequentially and/or at the same time. Multiple doses may be provided to each container 10.

Each micro-ingredient doser 130 also may include a flow sensor 180 positioned between the micro-ingredient supply 140 and the pump 150. The flow sensor 180 may be any type of conventional mass flow meter or a similar type of metering device such as a Coriolis meter, conductivity meter, lobe meter, turbine meter, or an electromagnetic flow meter. The flow meter 180 provides feedback to ensure that the correct amount of the micro-ingredient 135 from the micro-ingredient supply 140 passes into the pump 150. The flow sensor 180 also detects any drift in the pump 130 such that the operation of the pump 130 may be corrected if out of range.

The conveyor 100 also may include a number of dosing sensors 190 positioned along the conveyor 110 adjacent to each micro-ingredient doser 130. The dosing sensor 190 may be a check weight scale, a load cell, or a similar type of device. The dosing sensor 190 ensures that the correct amount of each micro-ingredient 135 is in fact dispensed into each container 10 via the micro-ingredient doser 130. Similar types of sensing devices may be used herein. Alternatively or in addition, the conveyor 100 also may include a photo eye, a high-speed camera, a vision system, or a laser inspection system to confirm that the micro-ingredient 135 was dosed from the nozzle 170 at the appropriate time. Further, the coloring of the dose also may be monitored.

The filling line 100 also may include one or more macro-ingredient stations 200. The macro-ingredient station 200 may be upstream or downstream of the micro-ingredient dosers 130 or otherwise positioned along the conveyor 110. The macro-ingredient station 200 may be a conventional non-contact or contact filling device such as those sold by Krones Inc. of Franklin, Wis. under the name Sensometic or by KHS of Waukesha, Wis. under the name Innofill NV. Other types of filling devices may be used herein. The macro-ingredient station 200 may have a macro-ingredient source 210 with a macro-ingredient 215, such as sweetener (natural or artificial), and a water source 220 with water 225 or other type of diluent. The macro-ingredient station 200 combines a macro-ingredient 215 with the water 225 and dispenses them into a container 10. The macro-ingredients 215, water 225, and/or the macro-ingredient station 200 may be heated to provide for a hot fill operation and the like.

One or more macro-ingredient stations 200 may be used herein. For example, one macro-ingredient station 200 may be used with natural sweetener and one macro-ingredient station 200 may be used with artificial sweetener. Similarly, one macro-ingredient station 200 may be used for carbonated beverages and one macro-ingredient station 200 may be used with still or lightly carbonated beverages. Other configurations may be used herein.

The filling line 100 also may include a number of positioning sensors 230 positioned about the conveyor 110. The positioning sensors 230 may be conventional photoelectric devices, high-speed cameras, mechanical contact devices, or similar types of sensing devices. The positioning sensors 230 may read the identifier 40 on each container 10 and/or track the position of each container 10 as it advances along the conveyor 110.

The filling line 100 also may include a controller 240. The controller 240 may be a conventional microprocessor and the like. The controller 240 controls and operates each component of the filling line 100 as has been described above. The controller 240 may be programmable.

The conveyor 100 also may include a number of other stations positioned about the conveyor 110. These other stations may include a bottle entry station, a bottle rinse station, a capping station, an agitation station, and a product exit station. Other stations and functions may be used herein as is desired.

In use, the containers 10, are positioned within the filling line 100 and loaded upon the conveyor 110 in a conventional fashion. The containers 10 may be sanitized before or after loading. The containers 10 are then transported via the conveyor 110 past one or more of the micro-ingredient dosers 130. Depending upon the desired final product, the micro-ingredient dosers 130 may add micro-ingredients 135 such as non-sweetened concentrate, colors, fortifications (health and wellness ingredients including vitamins, minerals, herbs, and the like), and other types of micro-ingredients 135. The filling line 100 may have any number of micro-ingredient dosers 130. For example, one micro-ingredient doser 130 may have a supply of non-sweetened concentrate for a Coca-Cola® brand carbonated soft drink. Another micro-ingredient doser 130 may have a supply of non-sweetened concentrate for a Sprite® brand carbonated soft drink. Likewise, one micro-ingredient doser 130 may add green coloring for a lime Powerade® brand sports beverage while another micro-ingredient doser 130 may add a purple coloring for a berry beverage. Similarly, various additives also may be added herein. There are no substantial limitations on the nature of the types and combinations of the micro-ingredients 135 that may be added herein. The conveyor 110 may split into any number of lanes such that a number of containers 10 may be co-dosed at the same time. The lanes then may be recombined.

The sensor 230 of the filling line 100 may read the identifier 40 on the container 10 so as to determine the nature of the final product. The controller 240 knows the speed of the conveyor 110 and hence the position of the container 10 on the conveyor 110 at all times. The controller 240 triggers the micro-ingredient doser 130 to deliver a dose of the micro-ingredient 135 into the container 10 as the container 10 passes under the nozzle 170. Specifically, the controller 240 activates the servomotor 160, which in turn activates the pump 150 so as to dispense the correct dose of the micro-ingredient 135 to the nozzle 170 and the container 10. The pump 150 and the motor 160 are capable of quickly firing continuous individual doses of the micro-ingredients 135 such that the conveyor 10 may operate in a continuous fashion without the need to pause about each micro-ingredient doser 130. The flow sensor 180 ensures that the correct dose of micro-ingredient 135 is delivered to the pump 150. Likewise, the dosing sensor 190 downstream of the nozzle 170 ensures that the correct dose was in fact delivered to the container 10.

The containers 110 are then passed to the macro-ingredient station 200 for adding the macro-ingredients 215 and water 225 or other type of diluents. Alternatively, the macro-ingredient station 200 may be upstream of the micro-ingredient dosers 130. Likewise, a number of micro-ingredient dosers 130 may be upstream of the macro-ingredient station 200 and a number of micro-ingredient dosers 130 may be downstream. The container 10 also may be co-dosed. The containers 10 then may be capped and otherwise processed as desired. The filling line 100 thus may fill about 600 to about 800 bottles or more per minute.

The controller 240 may compensate for different types of micro-ingredients 135. For example, each micro-ingredient 135 may have distinct viscosity, volatility, and other flow characteristics. The controller 240 thus can compensate with respect to the pump 150 and the motor 160 so as to accommodate pressure, speed of the pump, trigger time (i.e., distance from the nozzle 170 to the container 10), and acceleration. The dose size also may vary. The typical dose may be about a quarter gram to about 2.5 grams of a micro-ingredient 135 for a twelve (12) ounce container 10 although other sizes may be used herein. The dose may be proportionally different for other sizes.

The filling line 100 thus can produce any number of different products without the usual down time required in known filling systems. As a result, multi-packs may be created as desired with differing products therein. The filling line 100 thus can produce as many different beverages as may be currently on the market without significant downtime.

Figure 2A:
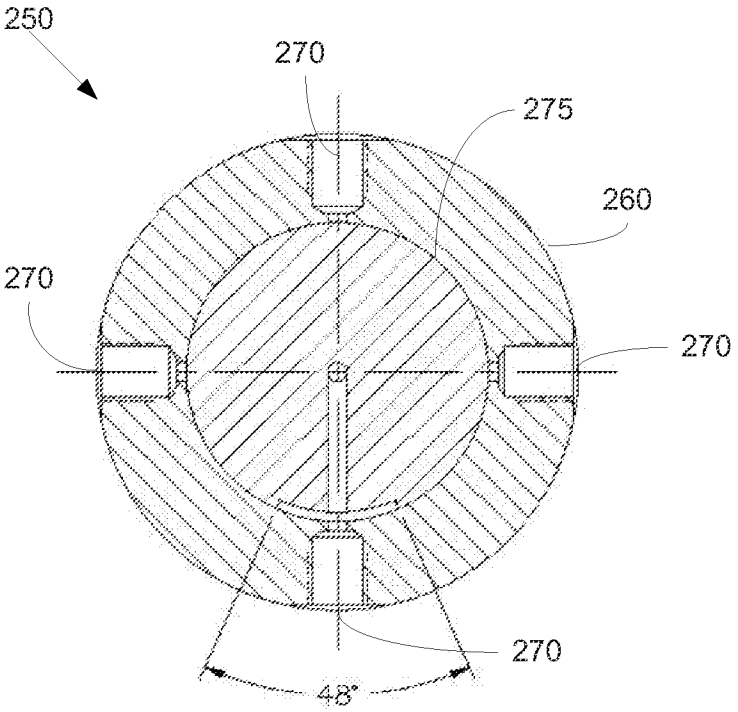
FIG. 2A is a cross-sectional view of a rotary nozzle for use in the alternative embodiment of FIG. 2.
Figure 2:
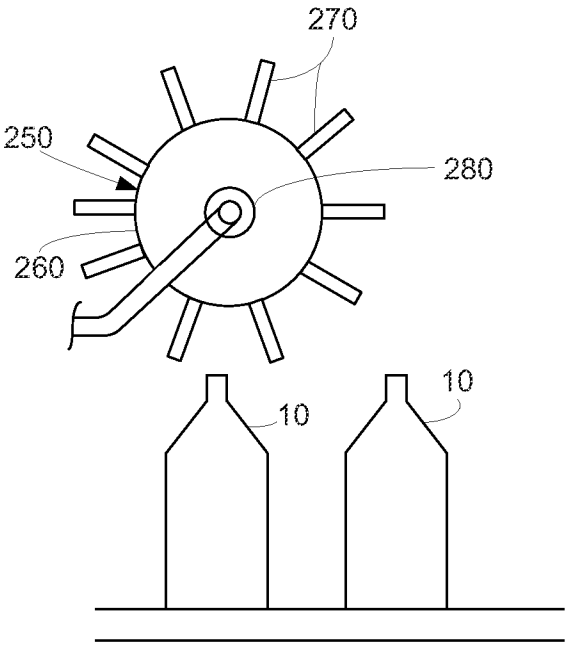
FIG. 2 is a side plan view of an alternative embodiment of a filing nozzle for use in the high speed filling line.

FIGS. 2 and 2A show an alternative embodiment of the nozzle 170 of the micro-ingredient doser 130 described above. This embodiment shows a rotary nozzle 250. The rotary nozzle 250 may include a center drum 260 and a number of pinwheel nozzles 270. As is shown in FIG. 2A, the center drum 260 has a center hub 275. As the pinwheel nozzles 270 rotate about the center drum 260, each nozzle 270 is in communication with the center hub 275 for example, about 48 degrees or so as in the example shown. The size of the center hub 275 and the communication angle may vary depending upon the desired dwell time. A nozzle 250 of any size also may be used herein.

A motor 280 drives the rotary nozzle 250. The motor 280 may be a conventional AC motor or similar types of drive devices. The motor 280 may be in communication with the controller 240. The motor 280 drives the rotary nozzle 250 such that each of the pinwheel nozzles 270 has sufficient dwell time over the opening 20 of a given container 10. Specifically, each pinwheel nozzle 270 may interface with one of the containers 10 at about the 4 o'clock position and maintain contact through about the 8 o'clock position. By timing the rotation of the pinwheel nozzles 270 and the conveyor 110, each pinwheel nozzle 270 has a dwell time greater than the stationary nozzle 170 by a factor of twelve (12) or so. For example, at a speed of fifty (50) revolutions per minute and a 48-degree center hub 275, each pinwheel nozzle 270 may have a dwell time of about 0.016 over the container 10 as opposed to about 0.05 seconds for the stationary nozzle 170. Such increased dwell time increases the accuracy of the dosing. A number of rotary nozzles 250 may be used together depending upon the number of lanes along the conveyor 110.

Figure 3:
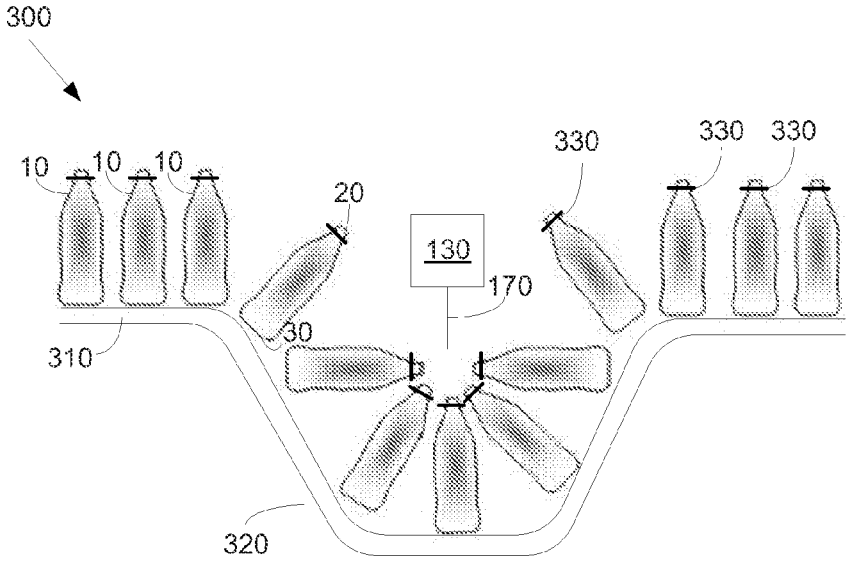
FIG. 3 is a side plan view of an alternative embodiment of a conveyor for use in the high speed filling line.

FIG. 3 shows a further embodiment of a filling line 300. The filling line 300 has a conveyor 310 with one or more U-shaped or semi-circular dips 320 positioned there along. The conveyor 310 also includes a number of grippers 330. The grippers 330 may grip each container 110 as it approaches one of the dips 320. The grippers 330 may be a neck grip, a base grip, or similar types of devices. The grippers 330 may be operated by spring loading, cams, or similar types of devices.

The combination of the dips 320 along the conveyor 310 with the grippers 330 causes each container 10 to pivot about the nozzle 170. The nozzle 170 may be positioned roughly in the center of the dip 320. This pivoting causes the opening 20 of the container 10 to accelerate relative to the base 30 of the container 10 that is still moving at the speed of the conveyor 310. As the conveyor 310 curves upward the base 30 continues to move at the speed of the conveyor 310 while the opening 20 has significantly slowed because the arc length traveled by the opening 20 is significantly shorter than the arc length that is traveled by the base 30. The nozzle 170 may be triggered at the bottom of the arc when the container 10 is nearly vertical. The use of the dip 320 thus slows the linear speed of the opening 20 while allowing the nozzle 170 to remain largely fixed. Specifically, the linear speed slows from being calculated on the basis of packages per minute times finished diameter to packages per minute times major diameter.

When in their concentrated state, the micro-ingredients 135 need not necessarily be microbiologically sterile because microorganisms and the like generally cannot propagate in such a concentrated environment, particularly where the micro-ingredients 135 are high in acid or contain highly concentrated ingredients that inhibit microbial or other types of growth. When such concentrated micro-ingredients are reconstituted, however, microorganisms may be able to begin to propagate. When a hot fill operation is used, the macro-ingredients 215 or other ingredients may be pasteurized before flowing into the container 10. Any microbiological load in the micro-ingredients 135 thus would be killed by the residual heat before the mixed product is cooled.

Another type of filling method is aseptic filling. In aseptic filling, all of the ingredients are sterilized before being added to the container 10. Aseptic filling thus may be performed without the addition of heat at the nozzle 170. As a result, the containers 10 themselves may be thinner or lighter as compared to those used with hot fill methods because of the lack of thermal expansion and contraction. Hot fill methods are preferred in some regions of the world while aseptic filling methods are preferred in others.

Figure 4:
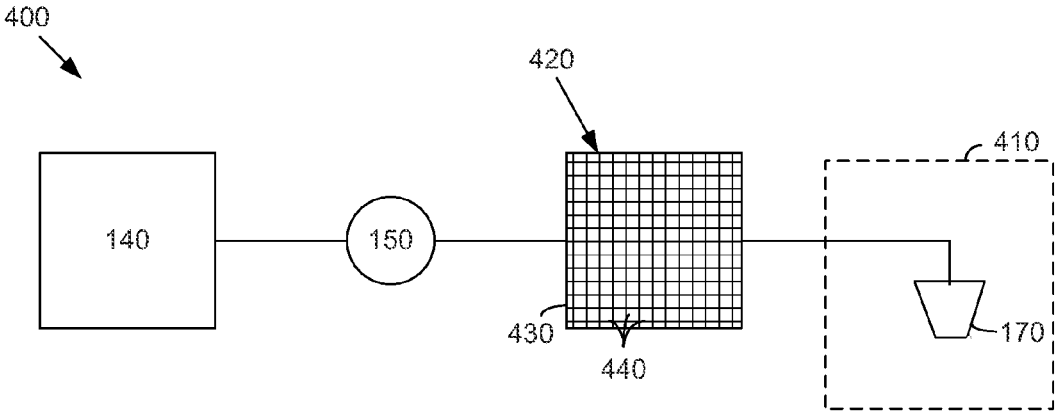
FIG. 4 is a schematic view of an aseptic dosing system as is described herein.

FIG. 4 shows an example of an aseptic filling system 400 as may be described herein. As above, the aseptic filling system 400 may include a number of micro-ingredient sources 140 with various types of micro-ingredients 135 therein. Each of the micro-ingredient sources 140 may be in communication with a dosing pump 150. Although only one micro-ingredient source 140 and one pump 150 are shown, any number may be used herein. The nozzle 170 may be positioned downstream of the dosing pumps 150. The nozzle 170 also may be in communication with one or more of the macro-ingredient sources 200.

The nozzle 170 and the container 10 may be positioned within a sterile zone 410. The sterile zone 410 may include a reverse pressure air system to keep contaminates out. Other types of sterilization methods may be used herein. The containers 10 generally are sterilized before entering the sterile zone 410.

The aseptic filling system 400 also may include a sterilizer 420. In this example, the sterilizer 420 may be in the form of a filter or a mesh 430. The mesh 430 may be sized with a number of openings 440 therethrough. The openings 440 may be sized at less than about 0.45 microns or so. Such a sizing for the openings 440 has been found to prevent microorganisms and the like from passing therethrough while not damaging essential oils or flavors. Other sizes may be used herein. The mesh 430 may be made out of gold, other metals, ceramics, and the like. An example of a mesh 430 suitable for aseptic filtering herein is offered by Millipore Corporation of Billerica, Mass. under the "Durapore" brand filter. Other types of filters or meshes 430 and/or combinations thereof also may be used herein. The micro-ingredients 135 then may be reconstituted in the nozzle 170 or in the container 10 with the macro-ingredients 215 and/or diluent.

Figure 5:
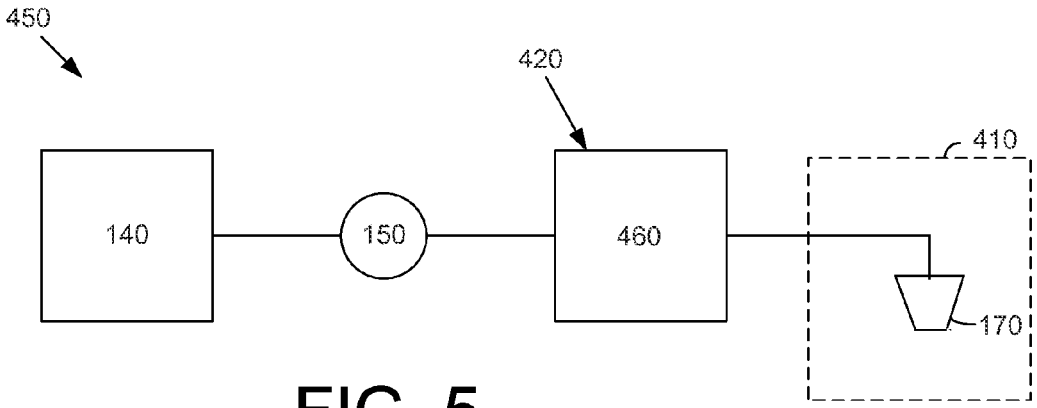
FIG. 5 is a schematic view of an alternative embodiment of the aseptic dosing system.

FIG. 5 shows a further embodiment of an aseptic filling system 450. In this embodiment, the sterilizer 420 may be in the form of a pasteurizer 460. The pasteurizer 460 serves to provide flash heating and cooling so as to kill any type of microorganism and the like in the flow of the micro-ingredients 135. An example of a pasteurizer 460 suitable for use herein is offered by Microthermics, Inc. of Raleigh, N.C. under the designation "S-2S" flash pasteurizer. Another type of pasteurizer is a microwave pasteurizer also offered by Microthermics under the designation of the "Focused" microwave module. Other types of pasteurizers and the like also may be used herein.

Figure 6:
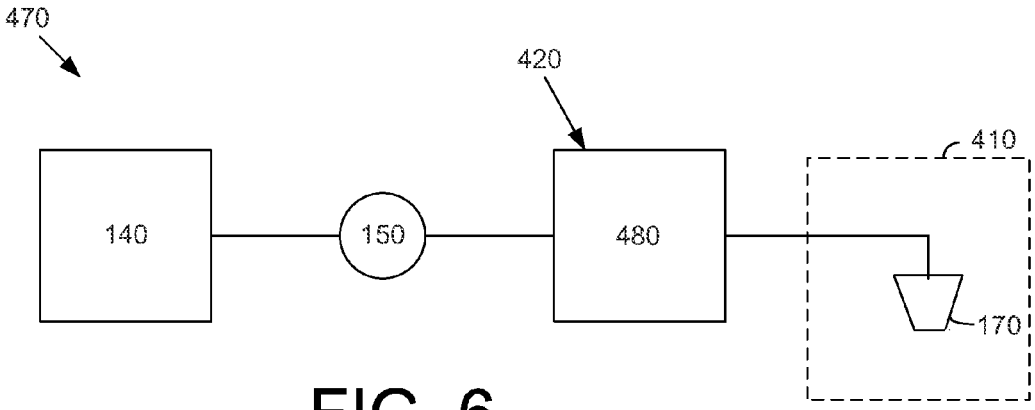
FIG. 6 is a schematic view of an alternative embodiment of the aseptic dosing system.

FIG. 6 shows a further embodiment of an aseptic filling system 470. In this embodiment, the sterilizer 420 may be in the form of an electron beam sterilization system or an E-beam system 480. The E-beam radiation is a form of ionizing energy used to kill any type of microorganism and the like in the flow of the micro-ingredients 135. The use of the E-beam system 480 has the advantage of being able to sterilize multiple fluid streams at one time. Further, the E-beam system 480 avoids the need for sterilizing chemicals and the like. An example of an E-beam system 480 suitable for use herein is offered by Advanced Electron Beams ("AEB") of Wilmington, Mass., under the designation "e250". Other types of E-beam systems and the like also may be used herein.

Figure 7:
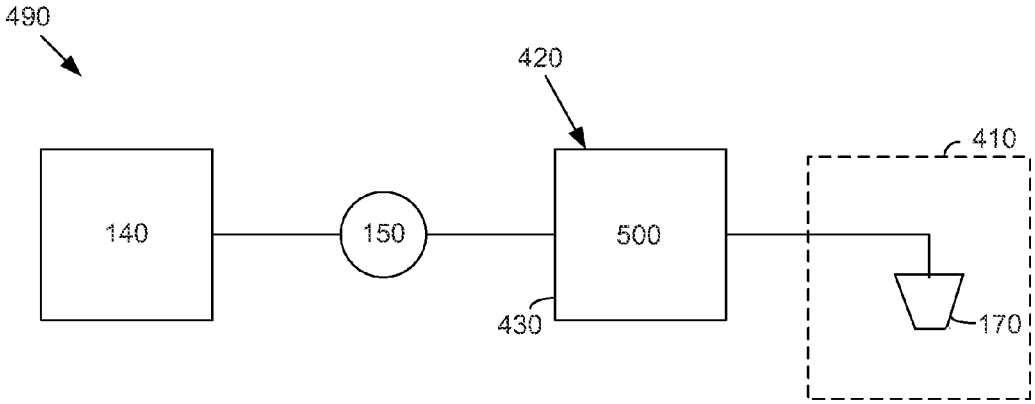
FIG. 7 is a schematic view of an alternative embodiment of the aseptic dosing system.

FIG. 7 shows a further embodiment of an aseptic filling system 490. In this embodiment, the sterilizer 420 may be in the form of an ultraviolet light source or UV source 500. The UV source 500 likewise uses ultraviolet light to kill any type of microorganism and the like in the stream of the micro-ingredients 135. The UV source 500 also avoids the need for sterilizing chemicals. An example of a UV source 500 suitable for use herein is offered by Claranor of Manosque, France described as a pulsed light sterilization system. Other types of UV sources and the like also may be used herein.

Figure 8:
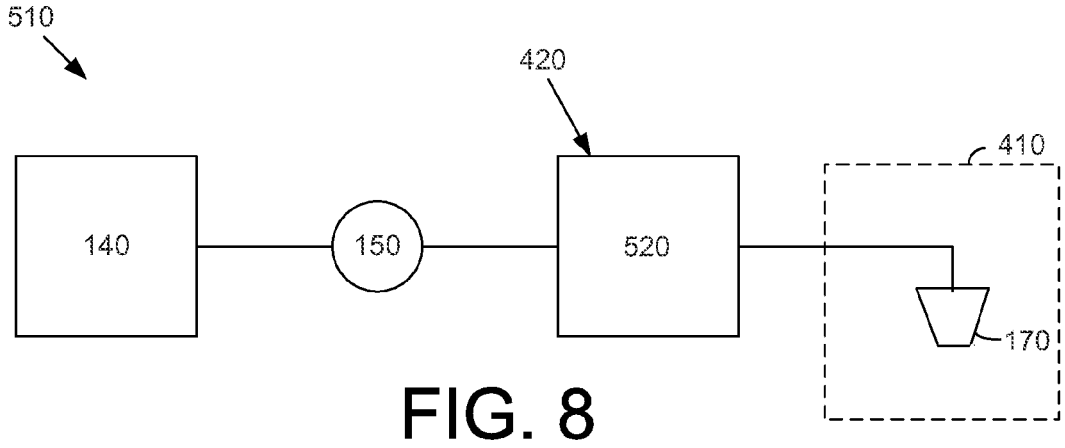
FIG. 8 is a schematic view of an alternative embodiment of the aseptic dosing system.

FIG. 8 shows a further embodiment of an aseptic filling system 510. In this embodiment, the sterilizer 420 may be in the form of a high pressure system 520. The high pressure system 520 may use high pressure and/or high pressure and temperature so as to kill any type of microorganism and the like in the stream of the micro-ingredients 135. The high pressure system 520 may use a series of pumps so as to create high pressure in the range of about 60 atmospheres (about 62 kilograms per square centimeter) or so. An example of a high pressure system 520 suitable for use herein is offered by Avure Technologies, Inc. of Kent, Wash. under the designation "HPP" Food Systems. Other types of high pressure systems and the like also may be used herein.

Figure 9:
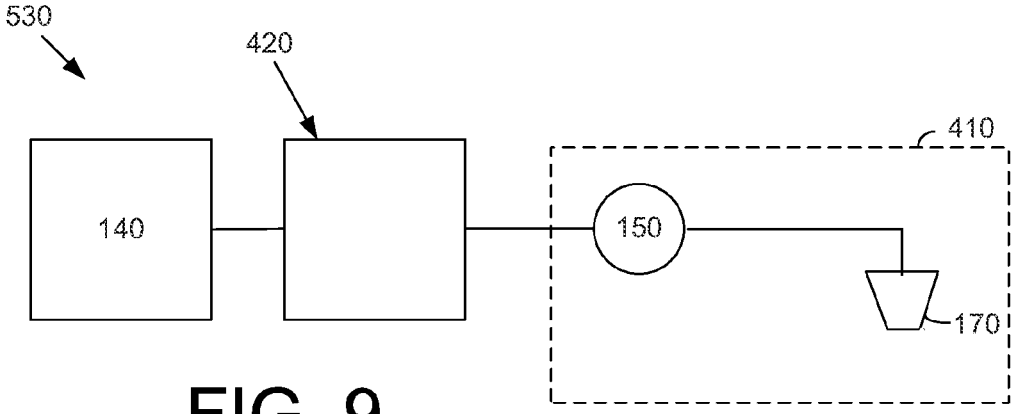
FIG. 9 is a schematic view of an alternative embodiment of the aseptic dosing system.

FIG. 9 shows a further embodiment of an aseptic filling system 530. In this embodiment, the sterilizer 420 may be positioned upstream of the dosing pump 150. The dosing pump 150 may or may not be positioned within the sterile zone 410. The sterilizer 420 may include the mesh 430, the pasteurizer 460, the E-beam system 480, the UV source 500, the high pressure source 520, combinations thereof, and/or other type of sterilizing means. The respective components herein may be positioned and ordered as desired.

Figure 10:
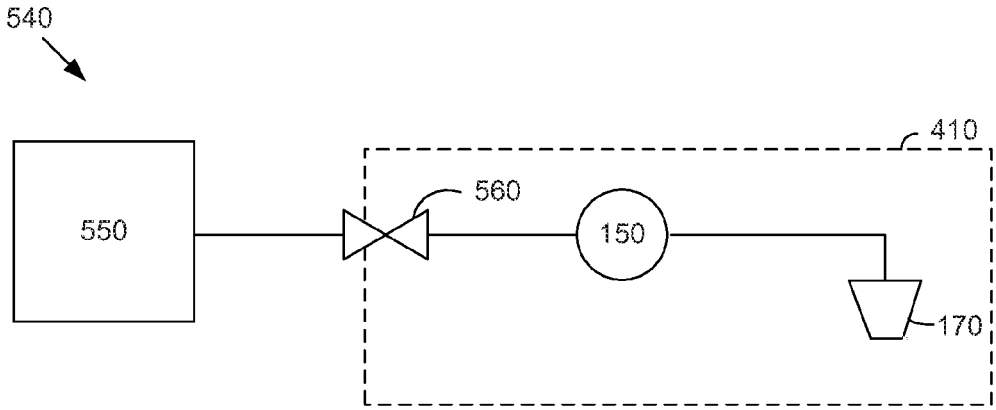
FIG. 10 is a schematic view of an alternative embodiment of the aseptic dosing system.

In addition to sterilizing at the nozzle 170, the micro-ingredients 135 also may be sterilized when packaged within the micro-ingredient source 140 itself. FIG. 10 shows a schematic view of such an aseptic filling system 540. In this example, the micro-ingredient source 140 may take the form of an aseptic micro-ingredient source 550. The aseptic micro-ingredient source 550 then may be transported to the filling line 100. The aseptic micro-ingredient source 550 may be connected to the aseptic filling system 540 via an aseptic fitting 560. In this example, the dosing pump 150 and the nozzle 170 may be positioned within the sterile zone 410. The use of the sterilizer 420 about the nozzle 170 therefore may not be required.

Certain types of micro-ingredients 135 may be better suited for certain types of sterilizers 420. For example, ethanol based micro-ingredients 135 may use any type of sterilizer 420 but may be particularly well suited for the use of the mesh 430. On the other hand, emulsion based micro-ingredients 135 tend to be more viscous and thus may not be well suited for the use of the mesh 430. Other types of sterilizers 420 therefore may be more appropriate for such fluids.

Although a number of aseptic filling systems and sterilizers 420 have been described above, the aseptic filling systems may use any combination of the sterilizers 420 in any order. The sterilization may take place in line or a reservoir may be positioned upstream of the nozzle 170. The use of the reservoir also may provide a constant pressure at the nozzle 170. As opposed to known filling systems that must be sterilized after each product run, the filling systems 100 described herein may run continuously for about 96 hours or more with multiple flavors through the use of multiple micro-ingredients 135.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. An aseptic dosing system for dispensing a plurality of micro-ingredients, comprising:

a micro-ingredient source adapted to dispense the plurality of micro-ingredients;

wherein the plurality of micro-ingredients comprises a reconstitution ratio of about ten to one or greater;

a sterilizer downstream of the micro-ingredient source;

wherein the sterilizer is configured to sterilize the plurality of micro-ingredients;

a nozzle downstream of the sterilizer;

wherein the nozzle is configured to reconstitute the plurality of micro-ingredients in or downstream thereof;

a macro-ingredient source in communication with the nozzle; and a diluent source in communication with the nozzle.

2. The aseptic dosing system of claim 1, further comprising a plurality of macro-ingredient sources in communication with the nozzle.

3. The aseptic dosing system of claim 1, further comprising a pump downstream of the sterilizer.

4. The aseptic dosing system of claim 1, further comprising a pump upstream of the sterilizer.

5. The aseptic dosing system of claim 1, further comprising a sterilized container downstream of the nozzle.

6. The aseptic dosing system of claim 1, further comprising a sterile zone and wherein the nozzle is positioned within the sterile zone.

7. The aseptic dosing system of claim 1, wherein the sterilizer comprises a mesh.

8. The aseptic dosing system of claim 7, wherein the mesh comprises openings of less than about 0.45 microns.

9. The aseptic dosing system of claim 1, wherein the sterilizer comprises a pasteurizer.

10. The aseptic dosing system of claim 9, wherein the pasteurizer comprises a microwave pasteurizer.

11. The aseptic dosing system of claim 1, wherein the sterilizer comprises an electron beam sterilization system.

12. The aseptic dosing system of claim 1, wherein the sterilizer comprises an ultraviolet light system.

13. The aseptic dosing system of claim 1, wherein the sterilizer comprises a high pressure system.

14. An aseptic filling method, comprising:

providing a plurality of micro-ingredients;

wherein the plurality of micro-ingredients comprises a reconstitution ratio of about ten to one or greater;

passing the micro-ingredients through a sterilizer;

flowing the sterilized micro-ingredients to a nozzle;

reconstituting the sterilized micro-ingredients in or downstream of the nozzle with a diluent; and mixing one or more macro-ingredients in or downstream of the nozzle.

15. The aseptic filling method of claim 14, wherein the step of passing one of the micro-ingredients through a sterilizer comprises passing one of the micro-ingredients through a mesh.

16. The aseptic filling method of claim 14, wherein the step of passing one of the micro-ingredients through a sterilizer comprises passing one of the micro-ingredients through a pasteurizer.

17. The aseptic filling method of claim 14, wherein the step of passing one of the micro-ingredients through a sterilizer comprises passing one of the micro-ingredients through an electron beam sterilization system.

18. The aseptic filling method of claim 14, wherein the step of passing one of the micro-ingredients through a sterilizer comprises passing one of the micro-ingredients through an ultraviolet light system.

19. The aseptic filling method of claim 14, wherein the step of passing one of the micro-ingredients through a sterilizer comprises passing one of the micro-ingredients through a high pressure system.

* * * * *